United States Patent [19]

Boda

[11] Patent Number: 4,461,608

[45] Date of Patent: Jul. 24, 1984

[54] REAR LOADER CONTAINER TIPPER

[75] Inventor: Robert H. Boda, Ooletewah, Tenn.

[73] Assignee: The Heil Co., Milwaukee, Wis.

[21] Appl. No.: 388,422

[22] Filed: Jun. 14, 1982

[51] Int. Cl.[3] ..... B66F 3/04

[52] U.S. Cl. ..... 414/408; 294/106; 414/739

[58] Field of Search ..... 414/406, 408, 421, 729, 414/739; 294/106

[56] References Cited

U.S. PATENT DOCUMENTS 3,762,586 10/1973 Updike ..... 414/408

FOREIGN PATENT DOCUMENTS 1355281 6/1974 United Kingdom ..... 414/406

*Primary Examiner*—Robert G. Sheridan

*Attorney, Agent, or Firm*—Michael, Best & Friedrich

[57] ABSTRACT

A container handling apparatus adapted to be supported on a rear loading refuse truck and for gripping a container and for causing the container to be dumped into the refuse truck. The apparatus includes a pair of clamping arms supported for movement between a first position spaced from opposite sides of the container and a clamping position where they clampingly engage the container. Apparatus is also provided for causing such movement of the clamping arms, that apparatus including a fluid cylinder including an extendable piston, the clamping arms being moved from the first position to the clamping position when the extendable piston moves from the retracted position to an intermediate position, and the clamping arms moved from the container gripping position to the dumping position as the piston moves to an extended position.

13 Claims, 8 Drawing Figures

REAR LOADER CONTAINER TIPPER

FIELD OF THE INVENTION

The invention relates to apparatus for use in handling refuse containers and to apparatus associated with refuse collecting trucks and for picking up refuse containers and for dumping refuse into the refuse collecting trucks.

BACKGROUND PRIOR ART

Prior art apparatus for use in collecting refuse and of the type including means for lifting a container and for dumping the contents of the container into a refuse truck commonly include generally square or rectangular containers. These containers normally include pockets on opposite sides of the containers, the pockets being adapted to house the arms of a lifting assembly. These containers are commonly comprised of a molded polyethylene material which is not particularly resistant to stress cracks, and the container tends to fail in the area of the "pockets".

An improved type refuse container for use with automatic loading has recently been developed and comprises a round container having increased durability. Refuse handling equipment adapted for use with these round containers commonly includes means adapted to extend outwardly from the side of the refuse truck for gripping the container and for loading the truck from the side. One substantial advantage of the use of the round containers is that unlike the rectangular containers, the round containers do not have to be oriented with pockets aligned with the lifting apparatus of the refuse collecting trucks. The handling equipment will grip the container in substantially any upright position.

It is anticipated that many municipalities will be converting from the use of the common manual rear loading refuse trucks to refuse trucks which have a side loading capability and means for gripping and lifting a round container from the curb. These municipalities may also have a number of the older rear loading trucks which are not fully depreciated or which are still fully operable. Accordingly, it is preferred that apparatus be provided to permit conversion of these vehicles to handle the same round containers as are used by the side loading automatic units.

SUMMARY OF THE INVENTION

The present invention provides a means for conveniently modifying a conventional rear loading refuse truck so that it includes apparatus adapted to pick up and dump round or cylindrical containers into the rear loading truck. The apparatus embodying the invention can be conveniently attached to a rearward side portion of a rear loading refuse truck to convert the rear loading truck for use in automatic container loading. The apparatus of the invention can be inexpensively added to a rear loading truck with minimum modification of the truck and with the addition of only a single hydraulic cylinder. The apparatus is also constructed so as to include components which are easily removed and repositioned so as to permit manual loading of the truck.

The apparatus embodying the invention also provides a means for gripping the container such that the container cannot be released by the gripping arms when the container is being raised or lowered. Only when the container is in the lowered position can the gripping arms release the container.

More particularly, the invention includes an apparatus comprising a pair of clamping arms moveable between a first position spaced from opposite sides of a container and a clamping position where they clampingly engage the container, and means for supporting the clamping arms for movement from the first position to the clamping position and for supporting the clamping arms such that they lift the container to a container dumping position. The apparatus also includes means for causing such movement of the clamping arms, this means including a fluid cylinder having an extendable piston, the piston being moveable between a retracted position and an extended position. Means are also provided for causing the clamping arms to move from the first position to the clamping position when the extendable piston moves from the retracted position toward the extended position, and then for causing the clamping arms to move from the container gripping position to the dumping position as the piston moves further to the extended position.

In a preferred embodiment of the invention the means for supporting the clamping arms includes a horizontally extending elongated support member having opposite ends, one end supporting the clamping arms. Means are also provided for moveably connecting the other end of the elongated support member to the side of the refuse truck.

The invention also includes an apparatus adapted to be supported on a rear loading refuse truck and for gripping a container and for dumping the container into the refuse truck, that apparatus including a pair of clamping arms moveable between a first position spaced from opposite sides of the container and a clamping position wherein they clampingly engage the container. Means are also provided for supporting the clamping arms for movement from the first position to the clamping position and for supporting the clamping arms for movement from a container engaging position to a container dumping position. The means for supporting the clamping arms includes an elongated member supported so as to extend horizontally from one side of the truck across a rearward portion of the truck. The apparatus also includes means for selectively removably joining the clamping arms to the elongated member and means for removeably connecting one end of the elongated member to the side of the truck and for pivotal movement between a horizontal operable position and a vertical stored position.

Various other features and advantages of the invention will be apparent by reference to the following description of a preferred embodiment, from the claims and from the drawings.

Figure 1:
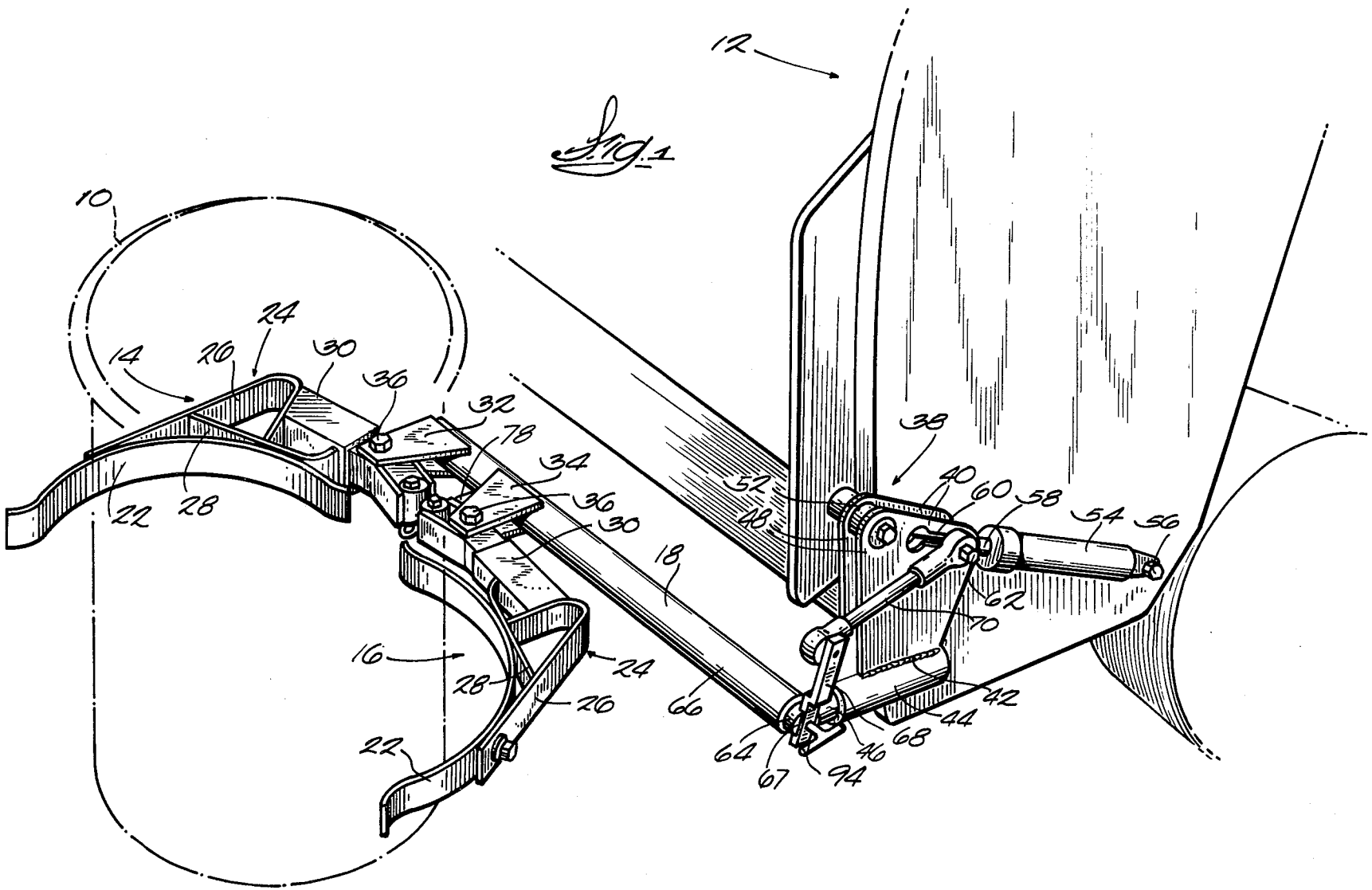
FIG. 1 is a perspective view of apparatus embodying the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a perspective view of an apparatus embodying the invention and including apparatus for clampingly engaging a refuse container 10 and for lifting and dumping that container into a rear-loading refuse truck 12. The apparatus generally includes a pair of clamping arms 14 and 16 adapted to be positioned on opposite sides of the container 10 and moveable from a first position, shown in FIG. 1, to a position where they clampingly engage the container 10. Means are also provided for supporting the clamping arms 14 and 16, this means for supporting generally including an elongated support member 18 adapted to extend horizontally across a portion of the rear of the truck 12. Means are further provided at one side of the truck 12 for supporting an end of the elongated support member 18 such that the elongated support member and the clamping arms 14 and 16 supported thereby are moveable from a first position wherein a container 10 supported on the ground can be grasped by the clamping arms 14 and 16 and a second position wherein the container 10 can be lifted and tilted approximately 135° to a refuse dumping position.

Referring more particularly to the clamping arms 14 and 16, while in other arrangements the clamping arms could have other constructions, in the illustrated embodiment they each include a curved or generally semi-circular metal band 22 having a radius of curvature approximating that of the round container 10, the opposed clamping arms 14 and 16 being adapted to substantially surround the container 10 when the clamping arms are moved into clamping engagement with the container. The semi-circular metal bands 22 are each supported by a frame assembly 24 comprised of a generally triangular frame member 26 and a second or transverse frame member 28, the frame members 26 and 28 being welded together and being welded to a pivotable arm 30.

While the elongated support member 18 could have various constructions, in the illustrated arrangement it comprises an elongated hollow tube having a circular cross-section configuration. One end of the tube is adapted to support the clamping arms 14 and 16 and includes a pair of bracket members 32 and 34 spaced apart in the direction of the longitudinal axis of the elongated hollow tube and fixed to the tube so as to extend outwardly from the tube. Each bracket member 32 and 34 supports one of the pivotable arms 30 of the clamping arms 14 and 16 for pivotable movement, the bracket 32 including a bore for housing a pivot pin 36 also extending through a bore in one of the pivotable arms 30 intermediate its opposite ends. The bracket 34 similarly supports the other pivotable arm 30 for pivotable movement about a verticle axis intermediate its opposite ends.

While the means for joining the one end of the elongated support member 18 to the side of the truck could have various constructions, in the illustrated arrangement it includes a pivotable lifting assembly or bell-crank assembly 38 supported for pivotable movement about the pivot axis of the truck gate. More particularly, in the illustrated arrangement the pivotable lifting assembly 38 includes a pair of parallel spaced apart plates 40. In a preferred form of the invention, means are also provided for joining the elongated support member 18 to the pivotable lifting assembly 38 such that the elongated support member 18 is pivotable from the horizontal position shown in FIG. 1 to a raised substantially vertical position wherein the longitudinal axis of the elongated support member lies in the vertical plane of the side of the truck. In the illustrated construction each of the plates 40 of the lifting assembly 38 has a lower edge 42 as seen in FIG. 1, that lower edge 42 being welded to a generally cylindrical tube 44 forming a socket. The elongated support member 18 includes a perpendicular end portion 46 rigidly joined to the horizontally extending portion and adapted to be housed in the cylindrical tube 44 so as to be rotatable therein about the longitudinal axis of the cylindrical tube 44.

Means are also provided for pivotably joining the lifting assembly 38 to the truck 12 for rotation about the pivot axis of the truck gate. In the illustrated construction, a pin 50 extends through upper portions 48 of the plates 40 in such a manner that the pin 50 functions as a pivot pin, and the lifting assembly 38 is pivotable about this pivot pin 50. A spacer member or bushing 52 surrounds the pin 50 and is positioned between the plates 40.

Means are further provided for causing selective clamping engagement of the clamping arms 14 and 16 with the container 10 and for then lifting the container and tipping the container such that the refuse in the container falls into the refuse truck 12. The means for causing such selective clamping engagement includes a single hydraulic cylinder 54 having one end pivotally joined to the side of the refuse truck by a pivot pin 56 and operably connected by suitable hydraulic lines to the hydraulic system of the truck. The hydraulic cylinder 54 includes an extendable hydraulic piston 58, the piston 58 being moveable from a retracted position to an intermediate position whereupon the clamping arms 14 and 16 are moved from their first position where they are spaced outwardly of the container 10 and a second position or clamping position where they clampingly engage the container 10. The piston 58 is moveable further from the intermediate position to a fully extended position whereby the clamping arms 14 and 16 lift the container 10 such that the contents of the container are dumped into the truck 12. In a preferred form of the invention the hydraulic cylinder 54 will comprise a conventional double acting cylinder with built-in restrictors to control the speed of extention and retraction of the cylinder piston 58.

In the illustrated arrangement, each of the pivotable plates 40 includes a longitudinally extending slot 60 therein. A pin 62 extends through the free end of the piston rod 58, and the opposite ends of the pin 62 are supported in the slots 60 for slideable movement between the retracted position shown in FIGS. 1 and 4 and the intermediate position shown in FIG. 5.

Figures 2, 3:
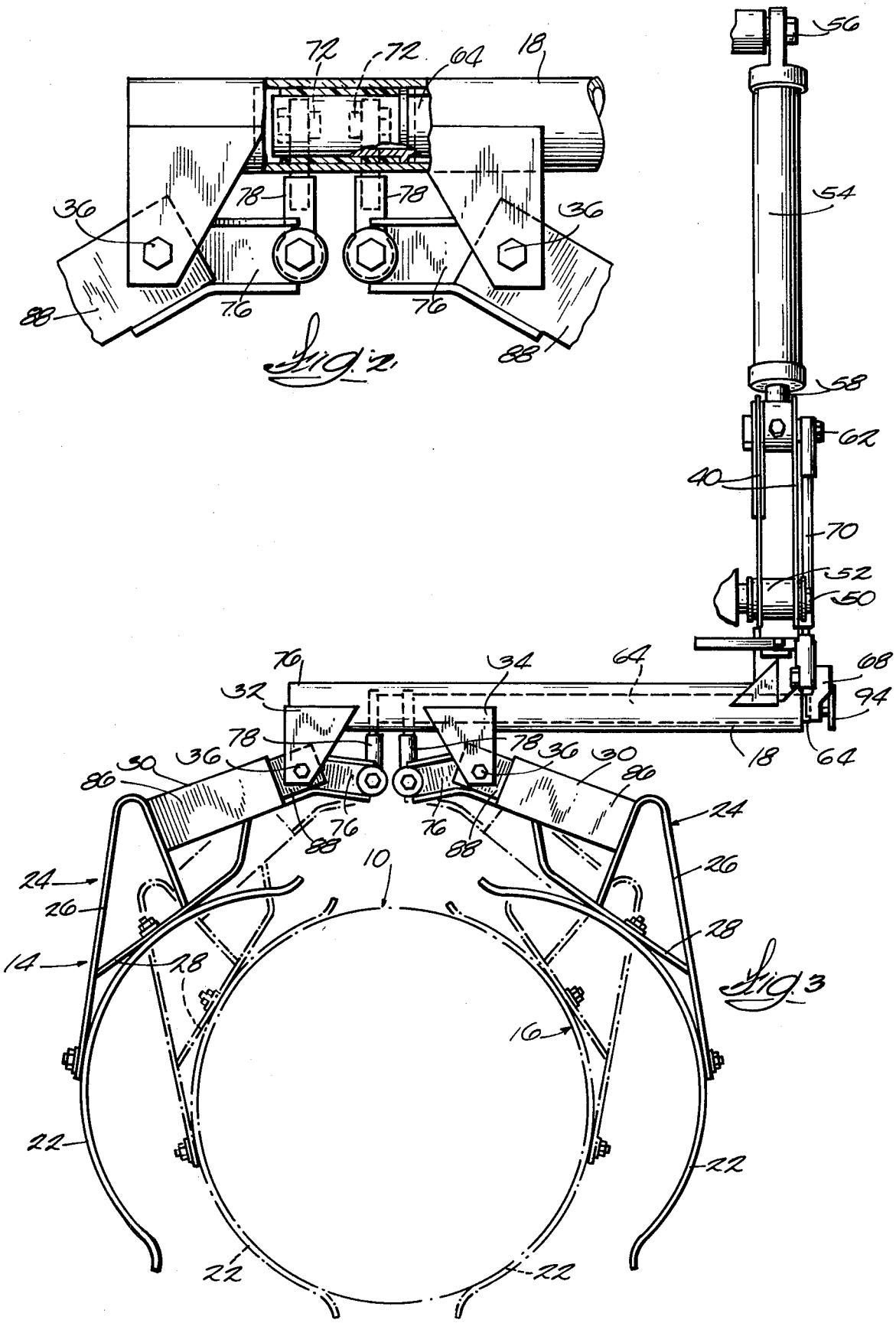
FIG. 2 is an enlarged plan view of a portion of the apparatus illustrated in FIG. 1 and with portions broken away.
FIG. 3 is a plan view of the apparatus illustrated in FIG. 1.
Figure 4:
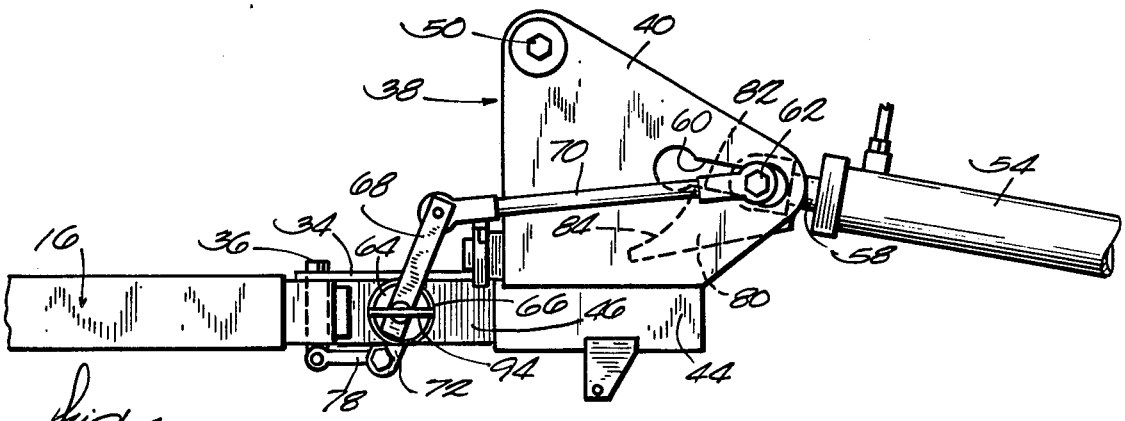
FIGS. 4–6 are side elevation views of the apparatus shown in FIG. 1.
Figure 5:
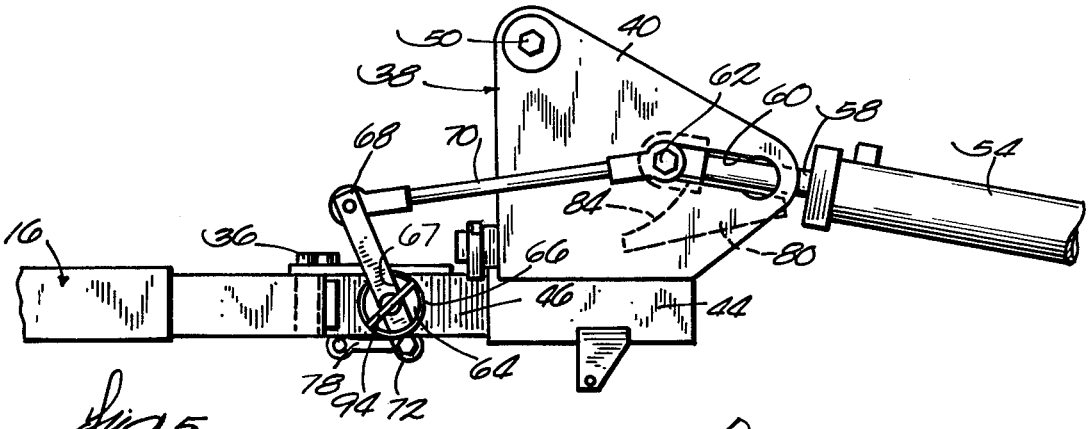

Means are further provided for causing movement of the clamping arms 14 and 16 from the spaced-apart position shown in solid lines in FIG. 3 to a clamping position shown in phantom in FIG. 3 in response to movement of the piston 58 from its retracted position (FIG. 4) to its intermediate position (FIG. 5). In the illustrated construction, this means for causing clamping movement of the clamping arms 14 and 16 includes a central shaft 64 (FIGS. 2 and 3) housed in the elongated tube 18 and extending along its length. The central shaft 64 is supported in the elongated tube 18 for selective pivotal movement about the longitudinal axis of the elongated tube 18. Means are provided for connecting one end of the elongated central shaft 64 to the piston 58 of the hydraulic cylinder 54 so as to provide for rotation of the central shaft 64 when the piston 58 moves from the retracted position shown in FIG. 4 to the partially extended or intermediate position shown in FIG. 5. One end of the elongated central shaft 64 projects from the end 66 of the elongated tube 18. The means for connecting the central shaft 64 to the piston includes a lever arm 68 having one end adapted to be joined to the end of the rotatable central shaft 64. The opposite end of the lever arm 68 is joined by a connecting rod or push rod 70 to the free end of the piston rod 58, one end of the connecting rod 70 being pivotally connected to the lever arm 68 and the opposite end of the connecting rod 70 being pivotally connected to the piston rod 58. As shown in FIGS. 4 and 5, as the piston 58 moves from the retracted position of FIG. 4 to the intermediate position of FIG. 5, the lever arm 68 will cause rotation of the central shaft 64 within the elongated support member 18.

Means are also provided for causing pivotal movement of the clamping arms 14 and 16 in response to such rotation of the central shaft 64. While such means could have various constructions, in the illustrated arrangement a pair of lever arms 72 (FIGS. 2 and 4–6) project downwardly from the opposite end of the central shaft 64 and extend through an opening (not shown) in a lower portion of the free end of the elongated horizontal support member 18. The downwardly extending lever arms 72 are fixed to the rotatable central shaft 64 such that the lower ends of the lever arms 72 are caused to move forwardly and rearwardly in response to pivotal movement of the elongated central shaft 64 within the elongated support member 18. Means are also provided for pivotally connecting the lower ends of the lever arms 72 to the free ends 76 (FIG. 2) of the clamping arms 14 and 16 and such that rearward movement of the lower ends of the lever arms 72 will cause pivotal movement of the clamping arms 14 and 16 to the open or spaced position and forward movement of the downwardly projecting lever arms 72 will cause clamping movement of the clamping arms 14 and 16. While this means for connecting could have various constructions, in the illustrated arrangement the lower ends of the lever arms 72 are connected by means of pushrods 78 to the free ends 76 of the clamping arms 14 and 16.

Means are also provided for preventing pivotal movement of the lifting assembly 38 about the axis of the pivot pin 50 as the piston 58 moves from the retracted position to the intermediate position where the clamping arms 14 and 16 clampingly engage the container 10. In the illustrated arrangement this means comprises a cam 80 fixed to the frame of the refuse truck and including an upper surface portion 82 slidably supporting the connecting pin 62. The cam 80 is positioned such that its cam surface portion 82 prevents downward movement of the free end of the piston 58 as the piston moves from the retracted position (FIG. 4) to the intermediate position (FIG. 5).

Figure 6:
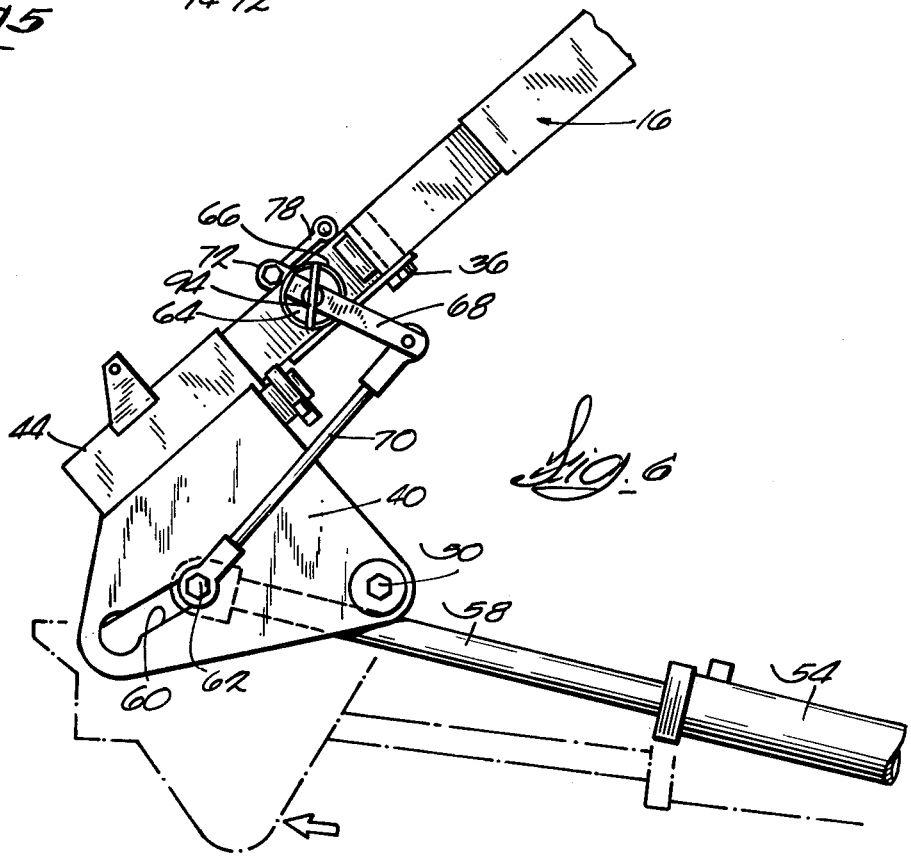
Figure 7:
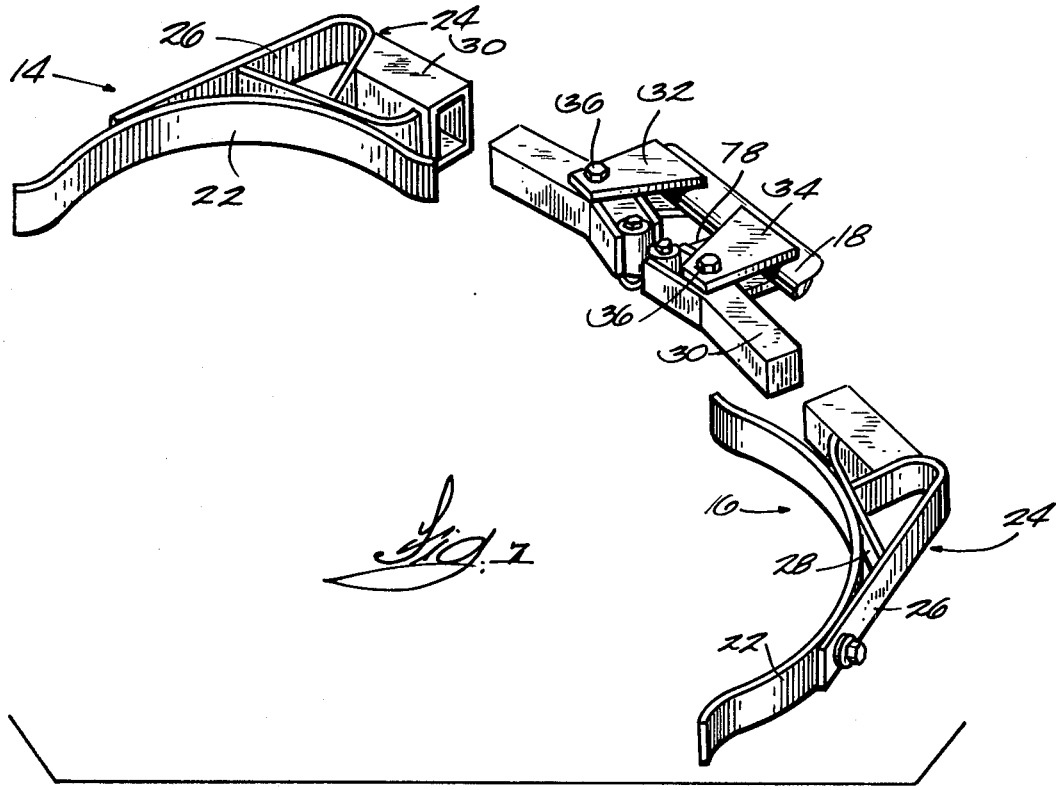
FIG. 7 is a partial view similar to FIG. 1 and showing the clamping arms in telescoping relation.
Figure 8:
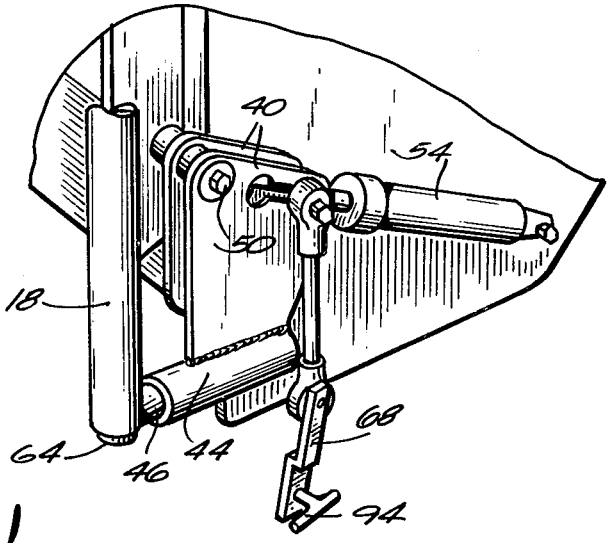
FIG. 8 is a partial view similar to FIG. 1 and showing the elongated support member of the apparatus in a vertical stored position.

Once, the pin 62 reaches the end of the slot 60, as seen in FIG. 5, further extension of the piston 58 will cause rotation of the lifting assembly 38, the elongated support member 18 and the clamping arms 14 and 16 about the axis of the pivot pin 50 toward the dumping position shown in FIG. 6. It should be noted that cam 60 includes a second surface portion 84 which permits the free end of the piston 58 to move downwardly once the piston 58 reaches the intermediate position wherein the container 10 is clampingly engaged, and the lifting assembly 38 can then rotate about the pivot pin 50 as shown in FIG. 6.

Upon retraction of the piston 58 the lifting assembly 38 will pivot in a counterclockwise directiion as seen in FIG. 6 and will return to the position shown in FIG. 5 wherein the container 10 is lowered to the ground. Further retraction of the piston 58 will then cause pivotal movement of the lever arm 68 from the position shown in FIG. 5 to that shown in FIG. 4 whereby the clamping arms 14 and 16 are caused to separate and the container is released.

It should be noted that the particular construction of the lifting assembly 38 and piston arrangement is such that there must be clamping engagement of the clamping arms 14 and 16 with container 10 before the container 10 can be lifted, and the container must then again be lowered to the ground before the clamping arms 14 and 16 can release the container. This arrangement provides safety in the lifting and dumping of the container since the container must be firmly gripped by the clamping arms before it can be lifted and at no time during the lifting of the container can the clamping arms release their grip on the container.

Means are further provided for releaseably joining the clamping arms 14 and 16 to the free end of the elongated support member 18 and in such a manner that the clamping arms 14 and 16 can be conveniently removed to thereby permit the refuse truck to be loaded manually. In the illustrated arrangement the support arms 30 are each comprised of a tubular or socket portion 86 being hollow and having a rectangular cross-section. The support arms 30 also each include a second portion 88 being adapted to be slidably housed in the hollow end of the tubular or socket portion 86. these second portions 88 of the clamping arms 14 and 16 are pivotably joined to the elongated support member 18 by the vertically extending bolts 36 and the brackets 32 and 34, respectively, referred to above. To remove the clamping arms 14 and 16, the socket portion 86 of each of the clamping arms is slidably pulled off the second portion 88 in the direction of the longitudinal axis of the socket portion 86. In a preferred form of the invention detent means (not shown) can be provided to preclude inadvertant removal of the clamping arms 14 and 16.

Means are also provided for supporting the horizontal support member 18 for pivotal movement such that it can be moved from the horizontally extending position shown in the drawings to an upwardly extending position wherein the elongated support member will generally lie in the vertical plane defined by the side of the refuse truck. Such pivotal movement of the elongated support member 18 to a vertical storage position further facilitates manual loading of the refuse truck when refuse containers are not of a size or shape which can be handled conveniently by the clamping arms 14 and 16. Referring more particularly to the means for supporting the elongated horizontal member 18 for such pivotal movement, as previously stated, one end of the elongated horizontal support member 18 comprises a cylindrical portion 46. This cylindrical portion 46 is housed in a tubular socket 44 and supported therein for rotation about the longitudinal axis of the socket 44. The socket 44 is in turn welded to the lifting assembly 38 so as to be carried by the lifting assembly 38. In a preferred form of the invention detent means (not shown) can be provided to preclude inadvertant pivotal movement of the cylindrical portion 46 in the socket 44 and removal of the cylindrical portion 46 from the socket. A suitable detent could comprise a removable pin adapted to extend through the socket 44 and the cylindrical portion 46.

Means are further provided for releaseably joining the lever arm 68 to the central rotatable shaft 64 so as to permit detachment of the lever arm 68 and thus permit pivotal movement of the elongated support member 18 to the vertical retracted position referred to above. In the illustrated construction, an end of the lever arm 68 is housed in a groove 67 cut in the projecting end of the central shaft 64. A wing bolt 94 extends through that end of the lever arm 68 and into a threaded bore in the end of the central shaft 64. By removing the wing bolt 94, the lever arm 68 can be removed from the slot 67 whereby the elongated support member 18 is then free to pivot about the longitudinal axis of the socket 44 to the retracted position.

Various features of the invention are set forth in the following claims.

I claim:

1. Apparatus adapted to be supported on a rear loading refuse truck and for gripping a container and for causing the container to be dumped into the refuse truck, said apparatus including a pair of clamping arms moveable between a first position spaced from opposite sides of the container and a clamping position wherein said clamping arms clampingly engage the container, means for supporting said clamping arms for movement from said first position to said clamping position and for supporting said clamping arms for movement from a container engaging position to a container dumping position, and means for causing movement of said clamping arms from said first position to said clamping position and for subsequently causing pivotal movement of said clamping arms from said container engaging position to said container dumping position, said means for causing movement of said clamping arms including an extendable member moveable between a retracted position and an extended position, and means for causing said clamping arms to move from said first position to said clamping position when said extendable member moves from said retracted position toward said extended position, and means for causing said clamping arms to move from said container gripping position to said dumping position as said extendable member moves to said extended position.

2. Apparatus as set forth in claim 1 wherein said means for supporting said clamping arms includes a horizontally extending elongated support member having opposite ends, one of said opposite ends pivotally supporting said clamping arms, and means for pivotally joining the other of said opposite ends of said elongated support member to the side of said refuse truck.

3. Apparatus as set forth in claim 2 wherein said means for supporting said clamping arms further includes means for removably joining said clamping arms to said elongated support member.

4. Apparatus as set forth in claim 2 wherein said elongated support member includes a longitudinal axis and wherein said means for pivotally joining the other of said opposite ends of said elongated support member to the side of the refuse truck includes means for supporting said elongated support member for pivotable movement about an axis parallel to said longitudinal axis of said elongated support member from a first position wherein said clamping arms extend rearwardly from said elongated support member and are in said container gripping position to a position wherein said clamping arms extend generally upwardly and are in said container dumping position.

5. Apparatus as set forth in claim 2 wherein said means for pivotally joining the other of said opposite ends of said elongated support member to the side of the refuse truck includes means for removably supporting said other end of said elongated support member.

6. Apparatus as set forth in claim 1 wherein said elongated support member comprises an elongated tube and wherein said means for causing said clamping arms to move from said first position to said clamping position includes an elongated shaft housed in said tube, said shaft having opposited ends and being supported in said tube for pivotable movement therein, means for connecting one end of said shaft to said extendable member and for causing pivotable movement of said shaft in said tube from a first shaft position to a second shaft position in response to movement of said extendable member from said retracted position toward said extended position, and means for connecting said clamping arms to the opposite end of said shaft, said means for connecting including means for causing movement of said clamping arms from said first position to said second position in response to movement of said shaft from said first shaft position to said second shaft position.

7. Apparatus adapted to be supported on a rear loading refuse truck and for gripping a container and for dumping said container into the refuse truck, the apparatus comprising a pair of clamping arms moveable between a first position spaced from opposite sides of the container and a clamping position wherein said clamping arms clampingly engage the container, means for supporting said clamping arms for movement from said first position to the clamping position and for supporting said clamping arms for movement from a container engaging position to a container dumping position, said means for supporting said clamping arms including an elongated support member having opposite ends, said elongated support member being supported so as to extend horizontally from one side of the truck across a rearward portion of the truck, means for selectively removably joining said clamping arms to said elongated support member, and means for removably connecting one end of said elongated member to the one side of said truck, said means for removeably connecting including means for supporting said one end of said elongated support member for pivotal movement between a horizontal operable position and a vertical stored position.

8. Apparatus as set forth in claim 7 wherein said means for removably connecting includes socket means for releaseably supporting said one end of said elongated member.

9. Apparatus as set forth in claim 8 wherein said means for removeably connecting further includes a cylindrical member fixedly joined to said one end of said elongated member, said cylindrical member being housed in said socket means for rotation between a first position wherein said elongated member extends horizontally from the side of said truck across a portion of the rear end of said truck, and a second position wherein said elongated support member projects upwardly.

10. Apparatus as set forth in claim 8 wherein said cylindrical member is selectively insertable and removable from said socket means.

11. Apparatus adapted to be supported on a rear loading refuse truck and for gripping a container and for causing the container to be dumped into the refuse truck, said apparatus including a pair of clamping arms moveable between a first position spaced from the sides of the container and a clamping position where they clampingly engage the container, means for supporting said clamping arms for movement from said first position to said clamping position and for supporting said clamping arms for movement from a container engaging position to a container dumping position, said means for supporting said clamping arms including an elongated horizontally extending support member, said support member having opposite ends and being supported so as to extend from one side of the refuse truck across a rearward portion of the truck, means for supporting said support member for pivotal movement about a generally horizontal axis whereby said clamping arms move from said container engaging position to a container dumping position, and means for causing movement of said clamping arms from said first position to said clamping position and for subsequently causing pivotal movement of said clamping arms from said container engaging position to said container dumping position.

12. Apparatus as set forth in claim 11 wherein said means for supporting said elongated support member for pivotal movement includes a lifting member, said elongated support member being fixed to said lifting member, and means for pivotally joining lifting member to the refuse truck for pivotal movement about said horizontal axis.

13. Apparatus adapted to be supported on a rear loading refuse truck and for gripping a container and for dumping said container into the refuse truck, the apparatus comprising a pair of clamping arms moveable between a first position spaced from opposite sides of the container and a clamping position wherein said clamping arms clampingly engage the container, means for supporting said clamping arms for movement from said first position to said clamping position and for supporting said clamping arms for movement from a container engaging position to a container dumping position, and means for causing movement of said clamping arms from said first position to said clamping position and for subsequently causing movement of said clamping arms to a container dumping position, said means for causing movement including means for preventing release of said container when said clamping arms are moved from said container engaging position.

* * * * *